United States Patent [19]

Hammer

[11] 4,388,564

[45] Jun. 14, 1983

[54] ENERGY SAVING FLUORESCENT LAMP CIRCUIT

[75] Inventor: Edward E. Hammer, Mayfield Village, Ohio

[73] Assignee: General Electric Company, Schenectady, N.Y.

[21] Appl. No.: 241,922

[22] Filed: Mar. 9, 1981

[51] Int. Cl.[3] ..... H05B 41/16

[52] U.S. Cl. ..... 315/227 R; 315/245; 315/291; 315/309; 315/DIG. 5

[58] Field of Search ..... 315/227 R, 291, 309, 315/DIG. 4, DIG. 5, 245

[56] References Cited

U.S. PATENT DOCUMENTS

| | | | |
|---|---|---|---|
| 3,323,013 | 5/1967 | Lord | 315/227 R X |
| 3,911,320 | 10/1975 | Crawford et al. | 315/227 R X |
| 3,954,316 | 5/1976 | Luchetta | 315/187 X |
| 3,956,665 | 5/1976 | Westphal | 315/95 |
| 4,082,981 | 4/1978 | Morton et al. | 315/309 X |
| 4,135,115 | 1/1979 | Abernethy et al. | 315/DIG. 5 |
| 4,163,176 | 7/1979 | Cohen et al. | 315/58 X |
| 4,185,231 | 1/1980 | Colliton | 315/189 |
| 4,185,233 | 1/1980 | Riesland et al. | 315/276 |

FOREIGN PATENT DOCUMENTS

| | | | |
|---|---|---|---|
| 53-18271 | 2/1978 | Japan | 315/291 |

*Primary Examiner*—Eugene R. La Roche

*Attorney, Agent, or Firm*—Norman C. Fulmer; Philip L. Schlamp; Fred Jacob

[57] ABSTRACT

A fluorescent lamp ballast circuit comprising conductors for connection to an electrical power source, and an impedance such as a capacitor connected between one of the conductors and the power source. A positive temperature coefficient resistor may be provided in parallel with the aforesaid impedance.

1 Claim, 1 Drawing Figure

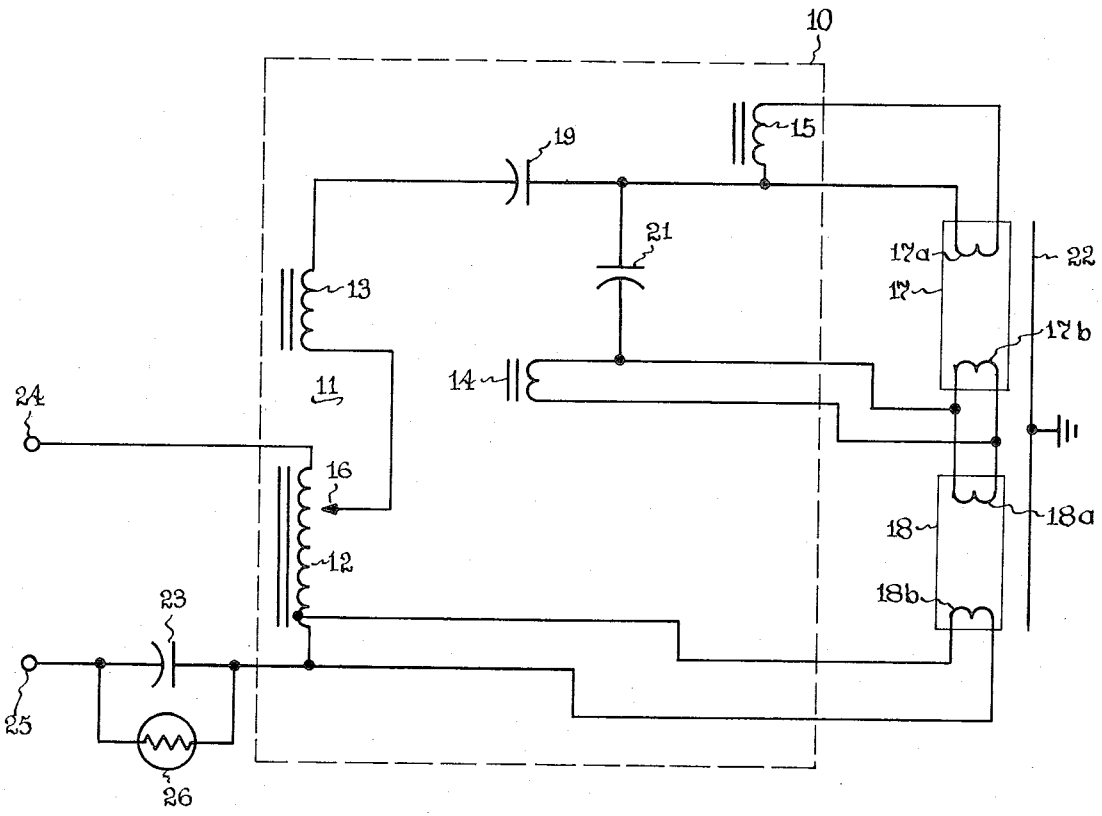
22
17b
18a
17a
17
18
18b
10
15
21
19
14
13
11
16
12
23
26
24
25

ENERGY SAVING FLUORESCENT LAMP CIRCUIT

BACKGROUND OF THE INVENTION

The invention is in the field of energy-saving fluorescent lamp circuits.

Various ways have been devised for placing capacitors in series with fluorescent lamps to reduce the lamp current and thus save electrical energy. This reduces the light output, and therefore such energy saving devices preferably are used only when the reduced light output is acceptable or tolerable. U.S. Pat. Nos. 4,082,981 and 4,163,176 disclose devices attached to an end of a fluorescent lamp and containing a capacitor connected electrically in series with the lamp. These arrangements require the use of fluorescent bulbs shorter than standard, or fixtures longer than standard, so that the bulb and attached capacitor device will fit between sockets of the fixture. Another approach has been to insert a capacitor in the ballast circuit and in series with the lamp or lamps and the secondary winding of the ballast transformer, such as disclosed in U.S. Pat. Nos. 3,323,013; 3,911,320; 3,954,316; and 4,135,115. U.S. Pat. No. 3,956,665 discloses a "phantom" fluorescent lamp which does not produce light and which contains a capacitor connected between a terminal at each end, and is intended to replace one of the lamps of a two-lamp system.

SUMMARY OF THE INVENTION

Objects of the invention are to provide a new energy-saving fluorescent lamp ballast circuit, and to provide such a circuit that can be implemented into existing conventional ballast circuits quickly, conveniently, and economically.

The invention comprises, briefly and in a preferred embodiment, a fluorescent lamp ballast circuit provided with conductors for connection to an electrical power source, and an impedance such as a capacitor connected in series with one of the conductors and the power source. A positive temperature coefficient resistor may be provided in parallel with the aforesaid impedance. These components are easily added to an existing ballast circuit by connecting them into one of the primary lead-in wires of the ballast circuit.

BRIEF DESCRIPTION OF THE DRAWING

The single FIGURE of the drawing is an electrical schematic diagram of a preferred embodiment of the invention.

DESCRIPTION OF THE PREFERRED EMBODIMENT

A housing 10, such as a metal box, contains a ballast circuit comprising a transformer 11 which has an input or primary winding 12, an output step-up or secondary winding 13, and a pair of cathode-heating windings 14 and 15. The windings are inductively coupled together, and the secondary 13 is connected to a tap 16 on the input winding 12, resulting in an autotransformer of which the true secondary is the winding 13 combined with the portion of winding 12 below the tap 16. Externally of the ballast housing 10, a pair of fluorescent lamps 17, 18, which may be conventional, contain cathodes 17*a*, 17*b*, and 18*a*, 18*b* near the ends thereof. Cathode 17*a* is connected across winding 15, and also is connected to an end of the secondary winding 13 via a power factor correction capacitor 19. The cathodes 17*b* and 18*a* are connected across the winding 14, and cathode 18*b* is connected across the lower reegion of winding 12. A capacitor 21 is connected across one of the lamps 17 and functions to facilitate starting of the other lamp 18, whereupon the lamp 17 starts readily. The numeral 22 indicates a conventional electrically grounded fixture for holding the lamps 17, 18, and which also aids in starting of the lamps.

The circuit thus far described is generally similar to, and if desired could be the same as the circuits disclosed in U.S. Pat. Nos. 4,185,231 and 4,185,233.

In accordance with the present invention an impedance such as a capacitor 23 is connected in series with the input winding 12 between a pair of electrical power input terminals 24, 25 for receiving operating electrical power such as 120 volts, 60 hz. Without the invention, the ends of the input winding 12 would be connected directly to the terminals 24, 25. The value of the capacitor or other impedance 23 is chosen so as to cause a reduction in electrical power to the circuit, thus conserving energy. This causes a reduction in light output of the lamps 17, 18, and preferably the amount of energy reduction is such that the light output level is acceptable or tolerable. A suitable inductor or resistor can be substituted for the capacitor 23; however, a capacitor is preferred because of its relatively small size, light weight, low cost, and it does not consume electrical power as would a resistor. In a ballast circuit as shown in the drawing, a capacitor 23 having a capacitance value of 10.8 microfarads reduced the system electrical input power to 40 watts, from its normal value of 100 watts (each of lamps 17, 18 being a 40 watt type), and reduced the light output to 188 light units from its normal value of 449 light units.

Although the lamps 17, 18 start fairly reliably in the circuit thus far described, preferably a positive temperature coefficient (PTC) resistor 26 is connected across the capacitor or other impedance 23 and functions to improve lamp starting reliability. The PTC resistor 26 has a low resistance, such as a few ohms, at room temperature, and when power is applied to the terminals 24,25 nearly full normal current flows through the PTC resistor 26 to the transformer 11 thus causing the lamp's cathodes to quickly heat to normal value for reliable starting of gas discharges in the lamps. The current flow in the PTC resistor 26 causes it to heat which in turn causes its resistance to increase considerably, for example, to a few hundred ohms or a few thousand ohms in a few seconds or minutes, whereupon most of the input current to the transformer flows through the capacitor 23 which functions to reduce the amount of energy consumed, as explained above. Only a small amount of current then flows through the PTC resistor 26, keeping it warm enough to have a relatively high resistance.

An important feature of the invention is the ease and convenience of installing the energy-saving components 23, 26 in existing fluorescent lighting installations. One of the input connection wires to the ballast housing 10 is cut, or removed from a terminal, and the components 23, 26 are connected into the circuit. For fluorescent light units provided with an electrical cord and plug, such as typically are used in homes, the energy-saving components 23, 26 can be provided in an adaptor which plugs into an electrical outlet, and the lamp unit plugs into the adaptor.

The invention's connection of energy-saving components in the input connection to the ballast, and externally of the ballast housing, is achieved considerably more quickly, easily, and economically than it would be to add components within the housing; conventional ballast housing are filled with potting compound such as pitch or tar to hold the parts in place. The invention also achieves economic and aesthetic advantages over the technique of providing an energy-saving capacitor for each individual lamp, at the output of a ballast circuit, as taught in the above-referenced patents which require specially made lamps, or adapter circuits requiring a transformer in addition to a capacitor.

While preferred embodiments and modifications of the invention have been shown and described, various other embodiments and modifications thereof will become apparent to persons skilled in the art and will fall within the scope of the invention as defined in the following claims.

I claim:

1. A fluorescent lamp operating circuit comprising a ballast circuit enclosed in a housing and having conductors externally of the housing for connection to an electrical power source, wherein the improvement comprises a capacitor connected in series with one of said conductors externally of said housing, thereby reducing electrical power to the circuit, and a positive temperature coefficient resistor connected across said capacitor.

* * * * *